US008222984B2

(12) United States Patent
Sakai et al.

(10) Patent No.: US 8,222,984 B2
(45) Date of Patent: Jul. 17, 2012

(54) ELECTROMAGNETIC TRANSDUCER

(75) Inventors: Shinichi Sakai, Chiyoda-ku (JP); Seiki Suzuki, Chiyoda-ku (JP); Kanji Shinkawa, Chiyoda-ku (JP)

(73) Assignee: Mitsubishi Electric Engineering Co., Ltd, Tokyo (JP)

( * ) Notice: Subject to any disclaimer, the term of this patent is extended or adjusted under 35 U.S.C. 154(b) by 220 days.

(21) Appl. No.: 12/675,929

(22) PCT Filed: Oct. 20, 2008

(86) PCT No.: PCT/JP2008/002968

§ 371 (c)(1),
(2), (4) Date: Mar. 1, 2010

(87) PCT Pub. No.: WO2009/054118

PCT Pub. Date: Apr. 30, 2009

(65) Prior Publication Data

US 2010/0214047 A1 Aug. 26, 2010

(30) Foreign Application Priority Data

Oct. 26, 2007 (JP) ..... 2007-279114

(51) Int. Cl.
*H01F 7/00* (2006.01)

(52) U.S. Cl. ..... 335/296; 335/229; 335/306; 600/25; 607/57; 607/55; 73/649; 73/652

(58) Field of Classification Search ..... 335/296–299, 335/302–306, 205–207, 229–234; 73/488–551, 73/570–672; 600/12, 25; 607/55–57
See application file for complete search history.

(56) References Cited

U.S. PATENT DOCUMENTS

2003/0150282 A1* 8/2003 May ..... 73/862.331
2004/0095217 A1* 5/2004 Loopstra ..... 335/179
2007/0126540 A1* 6/2007 Zimmerling ..... 335/205

FOREIGN PATENT DOCUMENTS

JP 56-68098 A 6/1981
JP 60-187199 A 9/1985
JP 3192372 B2 12/1997

OTHER PUBLICATIONS

Seibundo Shinkosha, "Speaker & enclosure encyclopedia", Section 2-25, May 1999, complied under the supervision of Tamon Saeki.

* cited by examiner

*Primary Examiner* — Bernard Rojas
(74) *Attorney, Agent, or Firm* — Sughrue Mion, PLLC

(57) ABSTRACT

Two layers of a plurality of rod-like permanent magnets each having a width Wm, a thickness Tm and a predetermined length are aligned on a plane in such a way that they have opposite magnetic pole orientations alternately and are aligned at a fixed pole pitch τp are arranged to be opposed to each other with the magnetic pole orientation of each magnet in one of the layers being identical to that of the opposing magnet in the other layer. The opposing surfaces of the magnets are spaced a distance 2×lg from each other, and a vibrating membrane on which coils each having a conductive pattern are arranged is placed in a gap between any two adjacent rod-like permanent magnets in each of the two layers, where lg is a distance from the vibrating membrane to the surface of a magnet. The arrangement of the rod-like permanent magnets is optimized by using Wm, Tm, τp, and lg.

8 Claims, 4 Drawing Sheets

ELECTROMAGNETIC TRANSDUCER

FIELD OF THE INVENTION

The present invention relates to an electromagnetic transducer provided with a coil pattern on each surface of a vibrating membrane disposed between permanent magnets arranged on an upper plane and permanent magnets arranged on a lower plane, for carrying out audio reproduction by applying an audio signal to this coil.

BACKGROUND OF THE INVENTION

As an example of a conventional electromagnetic transducer, there has been provided an electromagnetic transducer in which a permanent magnet plate is arranged to be opposed to a vibrating membrane, a shock absorbing material is placed between the permanent magnet plate and the vibrating membrane as needed, and the whole of the electromagnetic transducer is covered by a frame and formed into a rectangular shape. The permanent magnet plate used in this example has beltlike magnetization portions which are arranged at a fixed pitch and which have opposite magnetic pole orientations alternately. Furthermore, on a film surface of the vibrating membrane, a serpentine tangible pattern acting as a magnetic coil is formed in a portion which is called a magnetization neutral zone in such a way that two lines of the tangible pattern extend to be opposed to each other (for example, refer to patent reference 1). When a current of an audio signal is made to flow through the coil pattern formed on the vibrating membrane, the conductive pattern acting as a magnetic coil is electromagnetically coupled with the magnetization pattern of the permanent magnet plate, and the vibrating membrane having the above-mentioned conductive pattern vibrates according to the Fleming's law. A sound wave caused by this vibration is emitted out via a sound hole bored in the permanent magnet plate and a sound hole bored in the frame. In other words, the electromagnetic transducer carries out audio reproduction as a speaker.

Furthermore, there has been provided an ultra-thin speaker having the same structure as the above-mentioned electromagnetic transducer, i.e. a "Gamuzon type speaker" (for example, refer to nonpatent reference 1). This type of speaker is provided with a permanent magnet plate formed of rod-shaped block magnets, and its other components are the same as those of the conventional electromagnetic transducer shown above. The rod-like magnets are constructed and arranged in such a way that plural pairs of rod-like magnets having the same magnetic pole orientation (i.e. the north (south) poles of the two rod-like magnets in each pair are oriented in the same direction) are aligned in a direction perpendicular to the rod-like magnets with the magnetic pole orientations of the plural pairs of rod-like magnets being varied alternately. The electromagnetic transducer having this structure carries out generation of sound during audio reproduction in the same way that the example shown in the beginning of this section does.

[Patent reference 1] Japanese patent No. 3192372 gazette

[Nonpatent reference 1] Speaker & enclosure encyclopedia, Sections 2 to 25, compiled under the supervision of Tamon Saeki, Seibundo Shinkosha (issued in May 1999)

A problem with either of the conventional electromagnetic transducers as mentioned above is that it is difficult to provide a vibrating membrane that vibrates with a large amplitude, and therefore the sound pressure level of sound being played back in a low-pitched sound region is low. The main cause is the difficulty of enlarging the gap between the opposing permanent magnets in each pair. The reason why it is difficult to enlarge the gap between the opposing permanent magnets in each pair is because simple increase in the gap causes reduction in the magnetic flux density at a position of the coil pattern (i.e. a position of the vibrating membrane) which produces a driving force. Furthermore, because simple increase in the thickness of each magnet in order to increase the magnetic flux density causes increase in the magnetic flux density in the vicinity of the surface of each magnet, and the larger amplitude the vibrating membrane has, i.e. the nearer to the surface of each magnet the vibrating membrane is positioned, the larger driving force is generated, the vibrating membrane comes in contact with the permanent magnets and this results in a cause of creating a sound distortion and abnormal noise.

The present invention is made in order to solve the above-mentioned problems, and it is therefore an object of the present invention to provide an electromagnetic transducer that enables a low-pitched sound reproduction at a high-volume level.

DISCLOSURE OF THE INVENTION

In accordance with the present invention, there is provided an electromagnetic transducer in which a first magnet arrangement layer in which a plurality of rod-like permanent magnets each having a width Wm, a thickness Tm and a predetermined length are aligned in parallel with one another on a plane in such a way that they have opposite magnetic pole orientations alternately and are aligned at a fixed pole pitch Tp is formed, a second magnet arrangement layer in which a plurality of rod-like permanent magnets are aligned in a same way that those of the first magnet arrangement layer are aligned, and in such a way that they are arranged to be perpendicularly opposed to those in the first magnet arrangement layer with the magnetic pole orientation of each of the plurality of rod-like permanent magnets in the second magnet layer being identical to that of the opposing rod-like permanent magnet in the first magnet arrangement layer, and opposing surfaces of any two permanent magnets facing each other in the first and second magnet arrangement layers are spaced a distance $2\times lg$ apart from each other is formed, and a vibrating membrane on which coils each having a serpentine conductive pattern are arranged to be opposed to each other in such a way as to be placed in a gap between any two adjacent rod-like permanent magnets in each of the first and second magnet arrangement layers, and extend all over a surface corresponding to each of the magnet arrangement layers is placed at an intermediate position between the opposing surfaces of any two permanent magnets facing each other in the first and second magnet arrangement layers, and in which, when $\alpha=\tau p/lg$, $\beta=Wm/\tau p$, and $\gamma=Tm/lg$, the rod-like permanent magnets are arranged in such a way that $\beta<=0.15\alpha+0.1$ is satisfied.

As a result, because the cross sectional size of each of the rod-like permanent magnets and the pitch of the arrangement of the rod-like permanent magnets are optimized, the electromagnetic transducer can apply a driving force having a sufficiently large amplitude and being uniform in a driving range to the vibrating membrane even if the magnet gap between the two magnet arrangement layers is increased. Therefore, the electromagnetic transducer can carry out reproduction at a low-pitched sound region having higher quality than that provided by conventional electromagnetic transducers. More specifically, the electromagnetic transducer can implement a large amplitude and enables a low-pitched sound reproduction at a high-volume level.

PREFERRED EMBODIMENTS OF THE INVENTION

Hereafter, in order to explain this invention in greater detail, the preferred embodiment of the present invention will be described with reference to the accompanying drawings.

Embodiment 1

Figure 1:
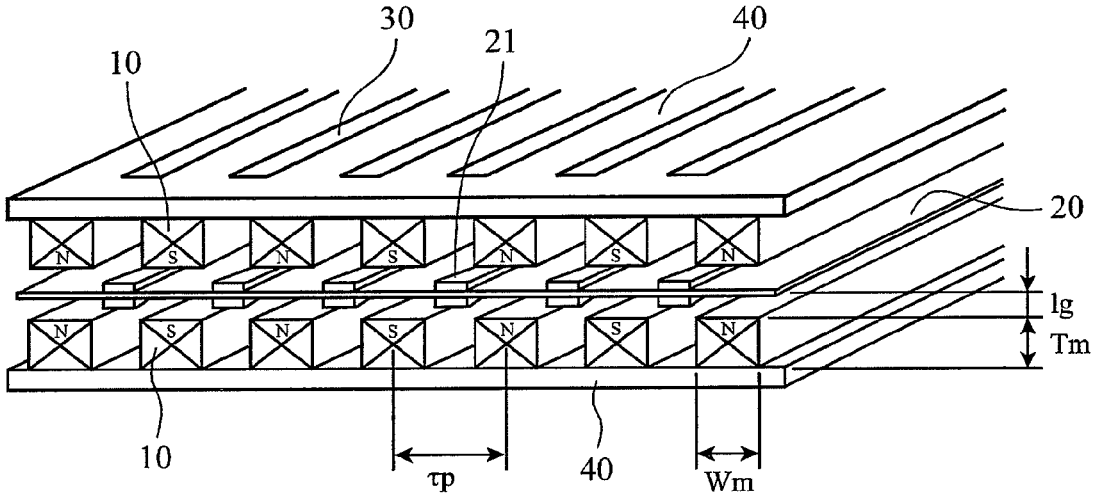
FIG. 1 is a perspective view showing the structure of an electromagnetic transducer in accordance with Embodiment 1 of the present invention.

FIG. 1 is a perspective view showing the structure of an electromagnetic transducer in accordance with Embodiment 1 of the present invention.

As shown in the figure, the electromagnetic transducer is provided with a first magnet arrangement layer in which a plurality of rod-like permanent magnets each having a width Wm, a thickness Tm and a predetermined length are aligned in parallel with one another on a plane in such a way that they have opposite magnetic pole orientations alternately and are aligned at a fixed pole pitch $\tau p$. Furthermore, the electromagnetic transducer includes a second magnet layer in which a plurality of rod-like permanent magnets 10 are aligned in the same way that those of the first magnet arrangement layer are aligned, and in such a way that they are arranged to be perpendicularly opposed to those in the first magnet arrangement layer with the magnetic pole orientation of each of the plurality of rod-like permanent magnets in the second magnet layer being identical to that of the opposing rod-like permanent magnet in the first magnet arrangement layer, and the opposing surfaces of two permanent magnets facing each other in the first and second magnetic layers are spaced a distance $2\times lg$ apart from each other. The plurality of rod-like permanent magnets 10 of each of these first and second magnet arrangement layers are adhered to a yoke 40 which is a magnetic body, and the yokes 40 are supported by a frame (not shown) together with a vibrating membrane 20 which will be mentioned below. A magnetic flux going out of one rod-like permanent magnet 10 mainly goes in a rightward or leftward direction, and exhibits an arc-shaped line of magnetic flux in a space in which the magnets are arranged to be vertically opposed to each other and reaches the other pole of the rod-like permanent magnet.

The sheet-shaped vibrating membrane 20 is placed at an intermediate position between the opposing surfaces of any two magnets facing each other in the first and second magnet arrangement layers which are layered in a vertical direction, i.e., at a position at the same distance lg from any of the opposing surfaces of any two magnets facing each other. In the vibrating membrane 20, coils 21 each having a serpentine conductive pattern are arranged to be opposed to each other in such a way as to be placed in a gap between any two adjacent magnets having opposite magnetic pole orientations in each of the first and second magnet arrangement layers, and extend all over a surface corresponding to each of the magnet arrangement layers. Therefore, the patterns of the coils 21 are arranged at positions where the plurality of rod-like permanent magnets 10 in the upper and lower layers of FIG. 1 produce a horizontal magnetic flux in any of the rightward and leftward directions. In this structure, when a driving current flows through the coils 21, a magnetic flux perpendicular to the driving current produces a force in an upward or downward direction of FIG. 1. This force makes the whole vibrating membrane 20 vibrate upwardly and downwardly to generate a sound by way of slits 30 formed in each of the yokes 40.

In the above-mentioned magnetic circuit structure, it is important for the electromagnetic transducer to generate a sound having a large level. Particularly, it is required to increase the magnetic flux density at the position where the coils 21 are arranged. To this end, there can be considered a measure of using permanent magnets having high magnetic energy, and a measure of reducing the gap between any opposing upper and lower magnets (i.e. the above-mentioned distance $2\times lg$ between the opposing surfaces of any two magnets facing each other which is twice the distance from the surface of each of the magnets to the vibrating membrane 20) to increase the magnetic flux density. However, narrowing the gap between any opposing upper and lower magnets results in imposing restrictions on the vibration of the vibrating membrane 20, and, particularly, large sound pressure is no longer acquired in a low-pitched sound region having a large amplitude.

To solve this problem, the present invention proposes a structure which enables an adequate magnetic flux density to be surely provided even if there is a large gap between any opposing upper and lower magnets, and which enables optimization of the size and arrangement of the permanent magnets to generate a large driving force. In addition, even if the vibrating membrane 20 vibrates with a large amplitude, the electromagnetic transducer maintains the driving force by reducing the change in the magnetic flux density in the vibrating direction (in a direction perpendicular to the vibrating membrane surface).

First, parameters defining the structure will be explained.

$\alpha$, $\beta$ and $\gamma$ are defined as $\alpha=\tau p/lg$, $\beta=Wm/\tau p$, and $\gamma=Tm/lg$. Furthermore, the magnetic flux density in a direction parallel to the surface of each of the magnets (in the rightward or leftward direction of FIG. 1) is expressed as Bmax, the magnetic flux density in the conductive portion of each of the coils 21 in the above-mentioned direction is expressed as Bmin, the "percentage of variations" in the magnetic flux density of the vibrating membrane 20 in the vibrating direction is expressed as $(Bmax-Bmin)/Br\times 100$, and the ratio of the magnetic flux density Bmin in the conductive portion of each of the coils to the residual magnetic flux density Br of each of the magnets, i.e. the "percentage of the conductive portion" which is the percentage of a portion at the position in which the conductor is not vibrating is expressed as $Bmin/Br\times 100$.

Figure 2:
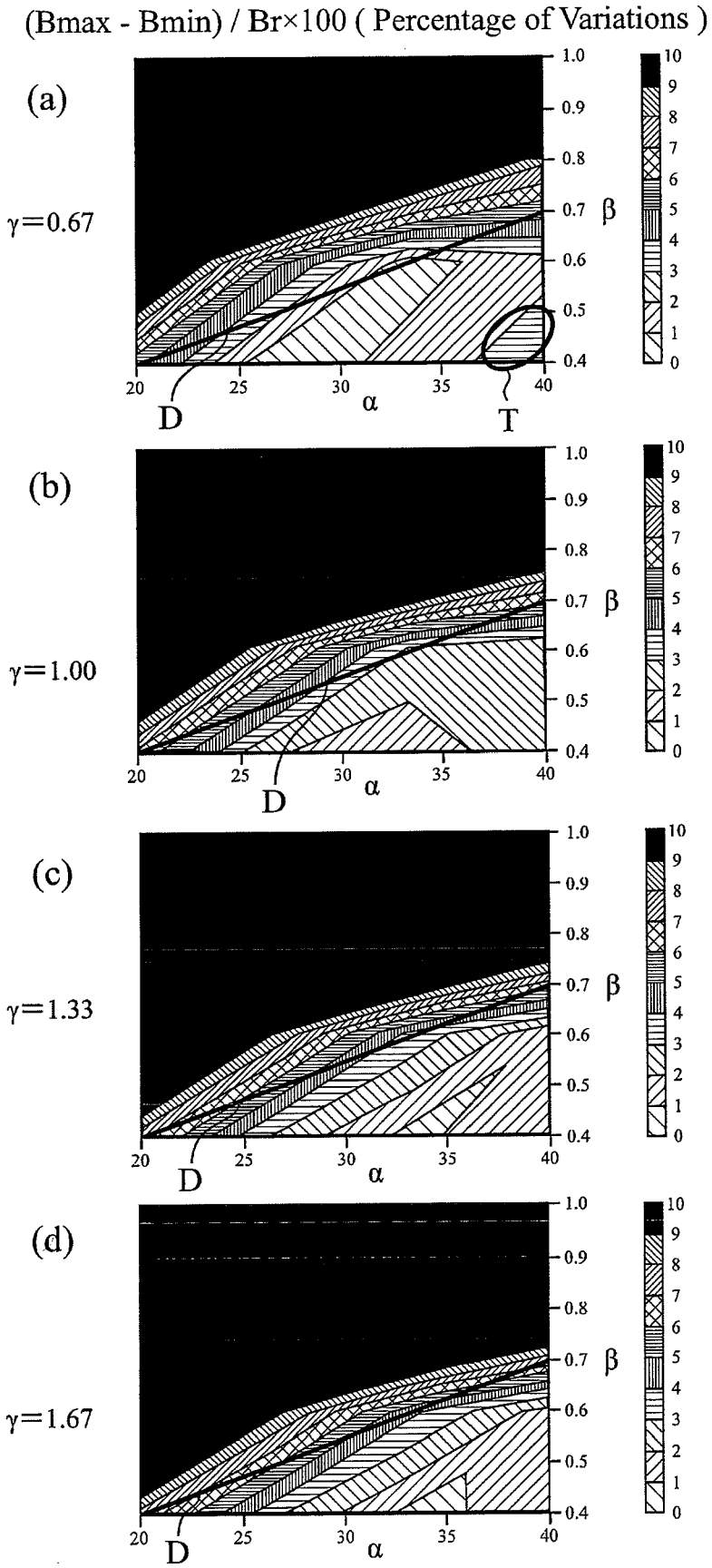
FIG. 2 is a distribution chart showing the "percentage of variations" in accordance with Embodiment 1 of the present invention.
Figure 3:
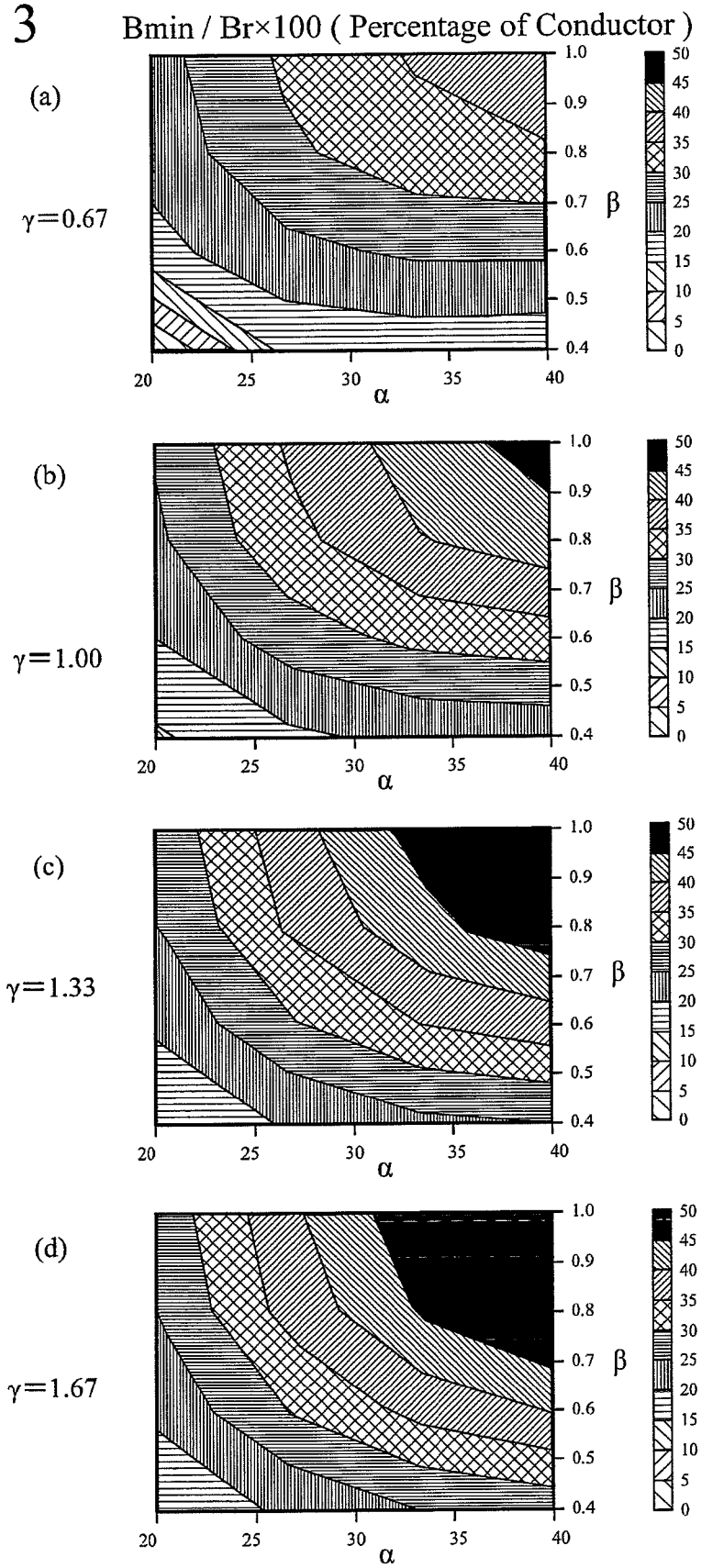
FIG. 3 is a distribution chart showing the "percentage of a conductive portion" in accordance with Embodiment 1 of the present invention.

On the above-mentioned conditions, electromagnetic field analysis is performed on various magnetic circuit structures. The results of calculation of the above-mentioned "percentage of variations" are shown in FIG. 2, and the results of calculation of the "percentage of the conductive portion" are shown in FIG. 3. In these figures, $\gamma=Tm/lg$ is used as a parameter ($\gamma$=0.67, 1.00, 1.33, or 1.67), and distribution charts in each of which the horizontal axis shows $\alpha=\tau p/lg$ and the vertical axis shows $\beta=Wm/\tau p$ are shown.

It is desirable that the "percentage of variations" (Bmax−Bmin)/Br×100 shown in FIG. 2 has a small value. The reason why it is desirable that the "percentage of variations" has a small value is because the smaller difference between the magnetic flux density at the coil position and that at the magnet position, the smaller change in the magnetic flux density, and, even if the vibrating membrane 20 vibrates greatly and then gets closer to the permanent magnets, the driving force can be maintained if the magnetic flux density has much the same value as that at the original coil position. In FIG. 2, the value of the "percentage of variation" becomes small almost in a region below a sloped line D in which the value is several percentages. However, in the case of $\gamma=0.67$, a region in which the value exceeds 3% appears in a right lower corner as shown in FIG. 2(*a*), and the appearance of this region is not desirable. As can be seen from this figure, it is desirable that the electromagnetic transducer in accordance with the present invention is constructed in such a way that the following requirement: $\gamma>=1.0$ is satisfied, and the thickness of each of the magnets Tm is greater than the distance lg between each of the rod-like permanent magnets 10 and the vibrating membrane 20. Furthermore, the sloped line D shown in FIG. 2 has the following relation: a straight line $\beta=0.15\alpha+0.1$, and a region which defines $\alpha$ ($=\tau p/lg$) and $\beta$ ($=Wm/\tau p$) is defined as $\beta<=0.15\alpha+0.1$ (a lower region under the straight line).

On the other hand, it is desirable that the "percentage of the conductive portion" Bmin/Br×100 shown in FIG. 3 has a large value because the residual magnetic flux density Br which is the original performance of each of the magnets appears effectively in the coil conductive portion. As can be seen from FIG. 3, it is clear that the "percentage of the conductive portion" increases as the point determined by the parameters gets closer to a right upper corner. In other words, it is preferable that the pole pitch $\tau p$ is large ($\alpha$: large), and it is also preferable that the magnet width Wm with respect to the pole pitch $\tau p$ is large ($\beta$: large). It is considered that the magnetic flux density in the vicinity of the surface of each of the magnets needs to be one-third or more of the residual magnetic flux density, and, in the present invention, the "percentage of the conductive portion" Bmin/Br×100 is preferably 35% or more.

In many present electromagnetic transducers, the gap between each permanent magnet and the vibrating membrane is 0.5 mm or less in length in many cases. In this state, when a large input current in a low-pitched sound region is applied to the coil, the vibrating membrane collides with the surfaces of some permanent magnets to create an unusual sound. As a measure against this collision, a shock absorbing material may be inserted between the permanent magnets and the vibrating membrane. Because this shock absorbing material is disposed in such a way as to be in contact with the permanent magnets and the vibrating membrane, it is clear that the shock absorbing material restricts the vibration of the vibrating membrane. More specifically, the reproduction of a low-pitched sound region is restricted and the electromagnetic transducer plays back a midrange or higher frequency range close to frequencies from 500 Hz to 1 kHz when operating as an electromagnetic transducer speaker. In contrast, the use of the present invention makes it possible to increase the gap lg between each of the rod-like permanent magnets 10 and the vibrating membrane 20. For example, the gap ranging from 1.0 mm to 1.5 mm or longer can be adopted. Because this gap lg can be increased this way, the shock absorbing material used for prevention of collision can be eliminated.

Figure 4:
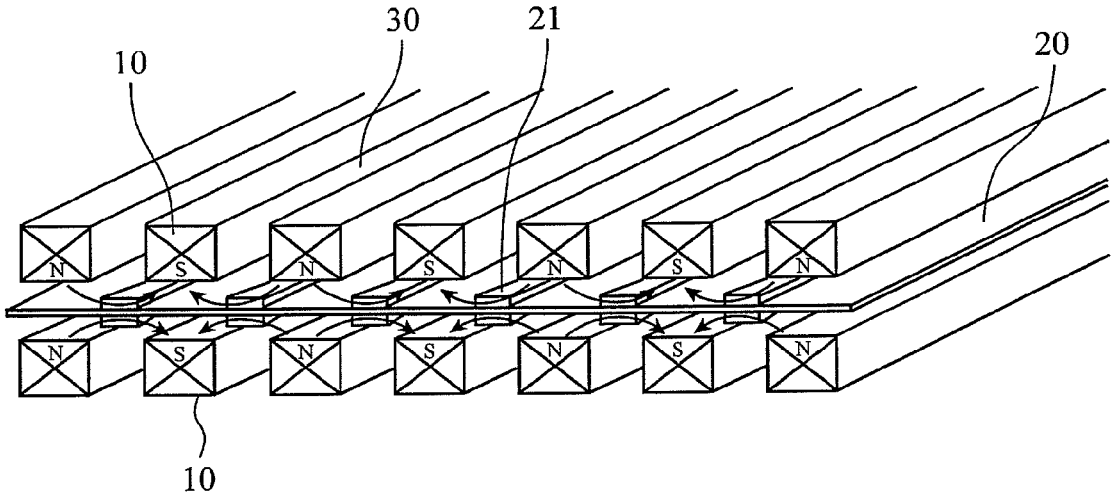
FIG. 4 is a perspective view showing the structure of another example of the electromagnetic transducer in accordance with Embodiment 1 of the present invention.

In the above-mentioned example shown in FIG. 1, the electromagnetic transducer comprised of the magnet arrangement layers in each of which the rod-like permanent magnets 10 are adhered to the yoke 40 which is a magnetic body, and the vibrating membrane 20 is explained. The present invention is not limited to this example. An electromagnetic transducer shown in FIG. 4 is another example of the present invention, and is constructed in such a way that no yoke is disposed, and rod-like permanent magnets 10 and a vibrating membrane 20 are held and fixed directly by a frame (not shown) disposed on both of front and rear ends of the electromagnetic transducer.

The slits 30 formed in each of the yokes 40 of FIG. 1 are rectangle shaped holes extending in the direction of the length of the rod-like permanent magnets 10, as shown in the figure. As an alternative, the slits can be formed into any shape as long as they do not interfere with the magnetic path formation and the sound created by the vibrating membrane 20 is emitted to outside the electromagnetic transducer without being attenuated. For example, circle or square shaped holes can be arranged between any two adjacent rod-like permanent magnets 10, or ellipse or polygon shaped holes can be arranged between any two adjacent rod-like permanent magnets As mentioned above, in accordance with this Embodiment 1, because the cross sectional size of each of the rod-like permanent magnets and the pitch of the arrangement of the rod-like permanent magnets are optimized, the electromagnetic transducer can apply a driving force having a sufficiently large amplitude and being uniform in a driving range to the vibrating membrane even if the magnet gap between the two magnet arrangement layers is increased. Therefore, the electromagnetic transducer can carry out reproduction at a low-pitched sound region having higher quality than that provided by conventional electromagnetic transducers. More specifically, the electromagnetic transducer in accordance with this embodiment can implement a large amplitude and enables a low-pitched sound reproduction at a high-volume level.

INDUSTRIAL APPLICABILITY

As mentioned above, because the electromagnetic transducer in accordance with the present invention can apply a driving force having a sufficiently large amplitude and being uniform in a driving range to the vibrating membrane, the electromagnetic transducer in accordance with the present invention is suitable for use in a flat type speaker that enables a low-pitched sound reproduction at a high-volume level.

The invention claimed is:

1. An electromagnetic transducer comprising:

a first magnet arrangement layer in which a plurality of rod-like permanent magnets each having a width Wm, a thickness Tm and a predetermined length are aligned in parallel with one another on a plane such that they have opposite magnetic pole orientations alternately and are aligned at a fixed pole pitch $\tau p$, a second magnet arrangement layer in which a plurality of rod-like permanent magnets are aligned in a same way as the rod-like permanent magnets of the first magnet arrangement layer are aligned, and are arranged to be perpendicularly opposed to those in the first magnet arrangement layer with a magnetic pole orientation of each of the plurality of rod-like permanent magnets in the second magnet layer being identical to that of an opposing rod-like permanent magnet in the first magnet arrangement layer, and opposing surfaces of any two permanent magnets facing each other in the first and second magnet arrangement layers are spaced a distance 2×lg apart from each other, and a vibrating membrane on which coils each having a serpentine conductive pattern are arranged to be opposed to each other in such a way as to be placed in a gap between any two adjacent rod-like permanent magnets in each of said first and second magnet arrangement layers, such that the coils extend along a surface corresponding to each of said magnet arrangement layers at an intermediate position between said opposing surfaces of any two permanent magnets facing each other in the first and second magnet arrangement layers, wherein:

when $\alpha=\tau p/lg$, $\beta=Wm/\tau p$, and $\gamma=Tm/lg$, said rod-like permanent magnets are arranged in such a way that $\beta<=0.15\alpha+0.1$ is satisfied, and lg is a distance from a surface of each of the magnets to the vibrating membrane, respectively.

2. The electromagnetic transducer according to claim 1, wherein when a magnetic flux density on a surface of each of the permanent magnets in a direction parallel to the opposing surfaces of any two permanent magnets facing each other and perpendicular to the rod-like permanent magnets is expressed as Bmax, a magnetic flux density in a conductive portion of each of the coils in said direction is expressed as Bmin, and a residual magnetic flux density of each of the magnets is expressed as Br, a percentage of variations (Bmax−Bmin)/Br×100 in a magnetic flux density in a vibrating direction of the vibrating membrane is 2% or less.

3. The electromagnetic transducer according to claim 1, wherein when a magnetic flux density in a conductive portion of each of the coils in a direction parallel to the opposing surfaces of any two permanent magnets facing each other and perpendicular to the rod-like permanent magnets is expressed as Bmin, and a residual magnetic flux density of each of the magnets is expressed as Br, a percentage of the conductive portion Bmin/Br×100 which is a percentage of a portion at a position in which the conductor is not vibrating is equal to or larger than 35%.

4. The electromagnetic transducer according to claim 1, wherein the distance lg>=1.0mm.

5. The electromagnetic transducer according to claim 1, wherein $\gamma>=1.0$.

6. The electromagnetic transducer according to claim 5, wherein when a magnetic flux density on a surface of each of the permanent magnets in a direction parallel to the opposing surfaces of any two permanent magnets facing each other and perpendicular to the rod-like permanent magnets is expressed as Bmax, a magnetic flux density in a conductive portion of each of the coils in said direction is expressed as Bmin, and a residual magnetic flux density of each of the magnets is expressed as Br, a percentage of variations (Bmax−Bmin)/Br×100 in a magnetic flux density in a vibrating direction of the vibrating membrane is 2% or less.

7. The electromagnetic transducer according to claim 5, wherein when a magnetic flux density in a conductive portion of each of the coils in a direction parallel to the opposing surfaces of any two permanent magnets facing each other and perpendicular to the rod-like permanent magnets is expressed as Bmin, and a residual magnetic flux density of each of the magnets is expressed as Br, a percentage of the conductive portion Bmin/Br×100 which is a percentage of a portion at a position in which the conductor is not vibrating is equal to or larger than 35%.

8. The electromagnetic transducer according to claim 5, wherein the distance lg>=1.0mm.

* * * * *